US006712156B2

(12) United States Patent
Fünfer

(10) Patent No.: US 6,712,156 B2
(45) Date of Patent: Mar. 30, 2004

(54) SWITCH ASSEMBLY FOR A COMBINED HAND TOOL DEVICE

(75) Inventor: Josef Fünfer, Königsbrunn (DE)

(73) Assignee: Hilti Aktiengesellschaft, Schaan (LI)

( * ) Notice: Subject to any disclaimer, the term of this patent is extended or adjusted under 35 U.S.C. 154(b) by 17 days.

(21) Appl. No.: 10/093,205

(22) Filed: Mar. 7, 2002

(65) Prior Publication Data

US 2002/0125020 A1 Sep. 12, 2002

(30) Foreign Application Priority Data

Mar. 12, 2001 (DE) ..... 101 11 748

(51) Int. Cl.[7] ..... E02D 7/02

(52) U.S. Cl. ..... 173/48; 173/104; 173/117; 173/114

(58) Field of Search ..... 173/48, 47, 104, 173/114, 117; 292/216, 217

(56) References Cited

U.S. PATENT DOCUMENTS

| | | | | | |
|---|---|---|---|---|---|
| 3,774,699 | A | * | 11/1973 | Schmuck | 173/48 |
| 3,828,865 | A | | 8/1974 | Schnizler, Jr. | |
| 4,442,906 | A | * | 4/1984 | Simpson | 173/48 |
| 4,732,218 | A | * | 3/1988 | Neumaier et al. | 173/105 |
| 4,763,733 | A | * | 8/1988 | Neumaier | 173/48 |
| 4,823,885 | A | * | 4/1989 | Okumura | 173/178 |
| 4,843,196 | A | * | 6/1989 | Bissig et al. | 200/336 |
| 4,998,588 | A | * | 3/1991 | Manschitz | 173/47 |
| 5,456,324 | A | * | 10/1995 | Takagi et al. | 173/48 |
| 5,787,996 | A | * | 8/1998 | Funfer | 173/104 |
| 5,842,527 | A | * | 12/1998 | Arakawa et al. | 173/48 |
| 6,035,945 | A | * | 3/2000 | Ichijyou et al. | 173/48 |
| 6,135,212 | A | * | 10/2000 | Georgiou | 173/48 |
| 6,176,321 | B1 | * | 1/2001 | Arakawa et al. | 173/48 |
| 6,460,627 | B1 | * | 10/2002 | Below et al. | 173/48 |

FOREIGN PATENT DOCUMENTS

| | | |
|---|---|---|
| GB | 2121717 | 1/1984 |

* cited by examiner

*Primary Examiner*—Rinaldi I. Rada
*Assistant Examiner*—Paul R Durand
(74) *Attorney, Agent, or Firm*—Sidley Austin Brown & Wood, LLP

(57) ABSTRACT

A switch assembly (1) for centrally arranged operating mode selection for an at least partially rotary and percussion combination hand tool device (2) is comprised of a first switch sleeve (11) for the switchable percussion drive (6) and a second switch sleeve (12) for the switchable rotary drive meshing with a tool spindle (4) via a countershaft (3) and a switch accessory (10) connecting both switch sleeves (11, 12) together, whereby the countershaft (3) and a percussion drive shaft (5) of the percussion drive (6) are arranged directly adjacent and parallel in a common axially extending zone (B) and rotationally-freely guide a driving gear pair (7) in direct meshing engagement with each other and which can be engaged by way of the switch sleeves (11, 12).

10 Claims, 1 Drawing Sheet

SWITCH ASSEMBLY FOR A COMBINED HAND TOOL DEVICE

FIELD OF THE INVENTION

The invention relates to a switch assembly for selecting the operating mode of an at least partially rotary and/or percussive hand tool device, such as a low-power rotary hammer drill or a chisel hammer.

BACKGROUND OF THE INVENTION

With such hand tool devices a percussion assembly is switchably driven, as required, using a common drive, such as an electrical motor, and via a percussive drive, for an axially reciprocating movement, as well as by way of a tool spindle. Moreover, the tool spindle can, as required, be freely moveable or stopped. To simplify operation mode selection, for example, of four operating modes, "rotary drilling", "rotary percussion boring", "chisel positioning", "chiseling" it can be effected by using, for the most part, a rotary actuation element.

According to JP9239675 a hand tool device with a countershaft parallel to the tool spindle is characterized by a central switch assembly for mode selection, including the operating mode "chisel positioning", having a rotary mode selection switch for a coaxial switch sleeve, which switches a countershaft, and a rotary lock, which engages in the countershaft and housing.

According to EP759342B1, the rotary drive is switched by a centrally arranged switch assembly of a combination hand tool device for mode selection of four operating modes, including the operating mode "chisel positioning" of the rotary drive by means of a first switch sleeve, which is regulated by a rotary mode selector switch via a switch plate, on a conical pinion shaft, the arrest of the tool spindle relative to the housing is done by way of a second switch sleeve coaxial thereto. The costly and space-intensive direct locking of the tool spindle in the housing is over-dimensioned for small hand tool devices up to 800 W power consumption.

According to JP9070771 a hand tool device having a countershaft parallel to the tool spindle is characterized by a centrally arranged switching mechanism for mode change having two switch sleeves for the rotary drive and for the percussion drive, respectively, coaxially displaced on the common countershaft, controlled separately by a rotary mode switch, for the rotary drive and for the percussive drive, respectively.

SUMMARY OF THE INVENTION

The object of the invention is to provide a centrally arranged, compact switching mechanism for hand tool devices, especially for low output devices. A further object is to provide a technologically simple, centrally switchable tool spindle locking mechanism.

Essentially, a centrally arranged switch assembly for mode selection for an at least partially rotary and percussive combination hand tool device is characterized by a first switch sleeve for the switchable percussion drive and a second switch sleeve for the switchable rotary drive, which meshes with the tool spindle via a countershaft, and a switch accessory providing rotational free coupling of the switch sleeves with one another, whereby the countershaft and percussion drive shaft of the percussion drive are arranged adjacent and parallel in a common axially extending zone and rotationally-freely guiding a driving gear pair in meshed engagement with one another, and can be coupled by way of switch sleeves.

As a result of the two individually switchable shafts arranged in a common axial zone and in a parallel and adjacent arrangement, a very compact, central switch assembly can be achieved.

An advantage is that the axially displaceable switch accessory in the switch sleeves with radially interlocking coupling means, at their ends via rotationally-freely engaging switch dogs within the basic arrangement of the switch assembly is formed between the two shafts, and further is advantageously configured as an axially extending, metal plate part shaped at the opposite ends, whereby the free space between the shafts can be utilized for a geometrically integrated central switch control for both switch sleeves.

Advantageously, the axially displaceable switch accessory engages in a form-fitting manner with a manually operable actuation member located outside the housing of the hand tool device, and is configured advantageously as a rotary switch having an eccentrically arranged pin engaged in the switch accessory, whereby the operating modes can be ordered in a switching sequence.

Moreover, the switch accessory is axially spring-biased, whereby independent switching of the concrete situational assignment of the interlocking enmeshing coupling element is synchronized.

A further advantage is that, relative to a first axial end position of the switch accessory, only the second switch sleeve of the rotary drive is engaged, whereby the function "rotary boring" is attained. Furthermore, both switch sleeves are engaged relative to an axially adjacent intermediate position of the switch accessory, whereby the function "rotary percussion drilling" is effected. Moreover, only the first switch sleeve is engaged relative to a further axially adjacent intermediate position of the switch accessory and the second switch sleeve is rotationally-free, whereby the function "chisel positioning" is attained.

Preferably, the coupling element associated with the first switch sleeve is characterized axially by a rotationally-free undercut, whereby the decoupled end position can be realized in a technologically simple fashion.

Advantageously, the second coupling element exhibits radially bilaterally interlocking coupling members, by means of which alternatingly an additional coupling element can be connected.

The further coupling element is configured as a form ring that can be rotationally-free, and in a form-fitting manner inserted into the housing.

Further, the countershaft is coupled with the housing relative to a second axial end position of the switch accessory, whereby the first switch sleeve of the percussion drive is engaged, and by means of the meshed engagement with the tool spindle, the spindle is non-rotationally locked, whereby the function "chiseling" is possible.

Advantageously, the countershaft is oriented transverse to the tool spindle and meshingly coupled with it via a conical crown gear, whereby a shortened construction of the hand tool device is realized.

BRIEF DESCRIPTION OF THE DRAWING

The invention is more completely explained with reference to an advantageous embodiment shown in the drawing wherein.

DETAILED DESCRIPTION OF THE INVENTION

Figure 1:
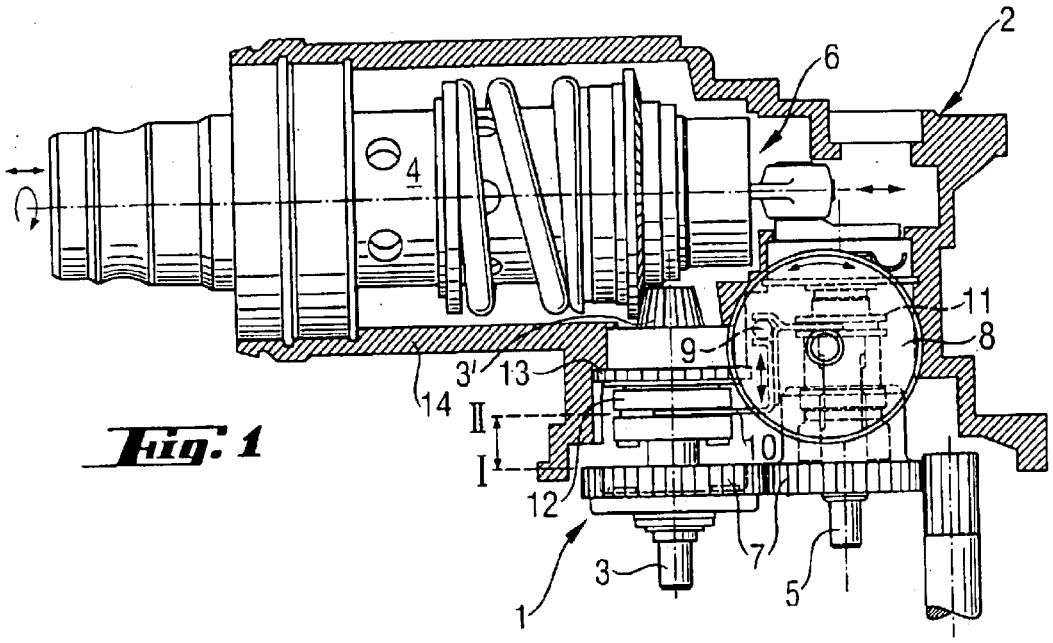
FIG. 1 is a side view, partly in section, of a switch assembly for a hand tool device.

In FIG. 1 a centrally arranged switch assembly 1 for operating mode selection in a schematically shown partially rotary and percussion combination hand tool device 2 comprising a housing 14 containing a countershaft 3 for a tool spindle 4 and a percussion drive shaft 5 for a percussion drive 6, which are directly adjacent and parallel arranged in a common axial zone B and in a rotation-free manner guide a driving toothed gear pair 7 directly meshed together. The countershaft 3 is arranged perpendicular to the tool spindle 4 and is in meshed engagement therewith via a conical crown gear 3'. A manually operable actuation means 8, partially accessible outwardly of the housing 14 is formed as a rotary switch engaging in a form-fitting manner via an eccentrically arranged pin 9, into a switch accessory 10 axially displaceable between a first end position I and a second end position II and a second switch sleeve 12. A ring 13 arranged coaxially to the countershaft 3 is rotation free and form-fittingly inserted into the interior of housing 14 of the hand tool device 2.

Figure 2:
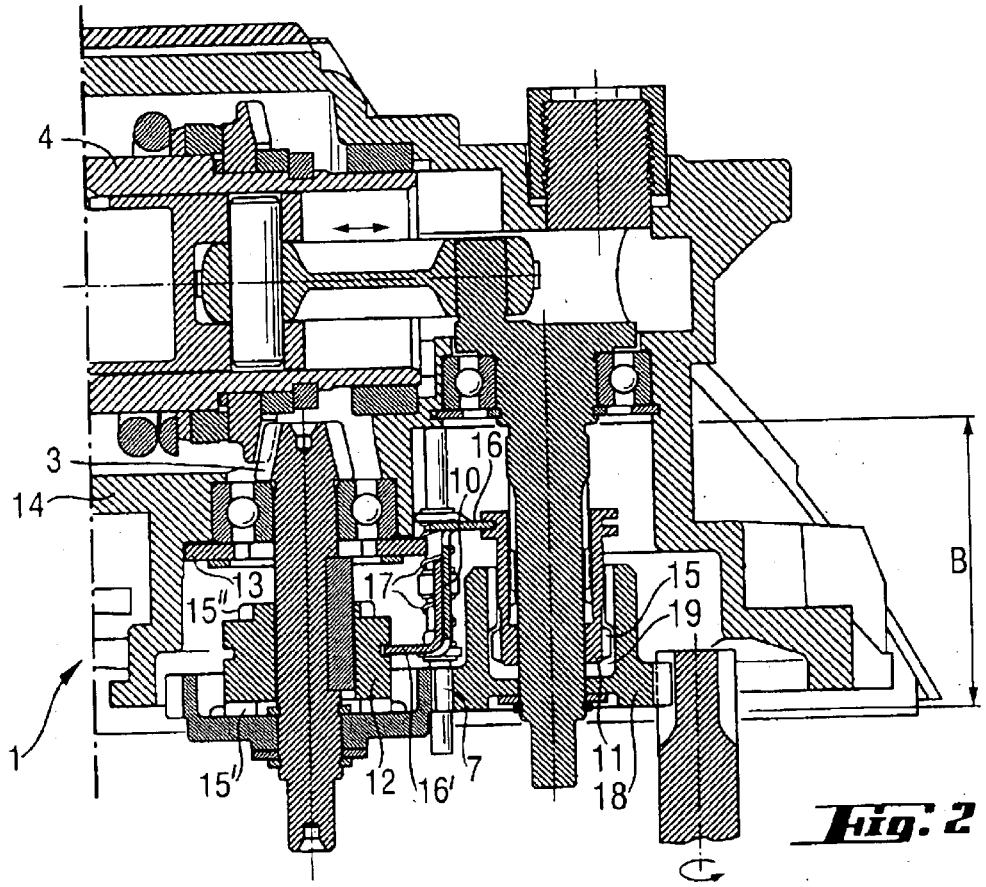
FIG. 2 is an enlarged side view of a portion of the side view of the switch assembly in FIG. 1.

According to FIG. 2 the switch assembly 1, a first switch sleeve 11 for the switchable percussion drive 6, and the second switch sleeve 12 for the rotary drive meshing with the tool spindle 4 via the countershaft 3, has a switch accessory 10 rotationally-freely connecting both first and switch sleeves 11, 12 with each other. In common axially extending zone B, the shafts 3, 5 are arranged as an eccentric shaft and conical pinion shaft, and switch sleeves 11, 12 individually switchable, are arranged directly adjacent and parallel relation The axially displaceable switch accessory 10 has at the axially spaced ends engaging switch dogs 16, 16' arranged within the basic geometry of the switch assembly 1 in the axially extending zone B between the two shafts 3, 5 and formed as an axially extending metal plate, with the axially spaced ends bent in opposite directions, from the axial direction, with spring 17 providing axial spring pretensioning of the metal plate construction. Toothed gear 18 on the gear pair 7 associated with the first switch sleeve 11 are characterized axially by a rotationally-free undercut 19. The second switch sleeve 12 is characterized by bilaterally radially interlocking coupling means 15', 15", whereby the coupling means 15" is configured to to be able to interlockingly engage the ring 13, which is inserted non-rotationally and in form-fitting manner into the housing 14.

What is claimed is:

1. A switch assembly for operating mode selection of an at least partially rotary and/or percussion hand tool device (2) including a housing (14) and comprising therein an axially extending first switch sleeve (11) for a percussion drive (6) and a second switch sleeve (12) for a percussion drive (6) and a second switch sleeve (12) for a rotary device in meshed engagement with a tool spindle (4) via an axially exending countershaft (3), and an axially extending switch accessory (10) interconnecting said first and second switch sleeves (11, 12) rotationally free of each other, said countershaft (3) and an axially extending percussion drive shaft (5) of said percussion drive (6) are arranged in laterally spaced and parallel relationship and directly adjacent one another in a common axially extending zone (B) and in a rotation free manner guide a pair of toothed driving gears (7) in directly meshed engagement and couplable by said first and second switch sleeves (11, 12), said switch accessory (10) interconnecting said first and second switch sleeves (11, 12) comprises form fitting coupling members (15, 15', 15") located on and extending radially outwardly of the axis of said first and second switch sleeve (11, 12), and said switch accessory (10) has axially spaced ends each containing a switch dog (16, 16') extendoing radially outwardly for engagement with said countershaft (3) and drive shaft (5), and said switch accessory (10) comprises an axially extending metal plate with said switch dogs (16, 16') extending radially outwardlly from opposite ends thereof transversely of the axial direction.

2. A switch assembly, as set forth in claim 1, wherein said switch accessory (10) is axially displaceable and engages in a form locked manner into a manually operable actuation member (8) located at least in part externally of said housing (14).

3. A switch assembly, as set forth in claim 2, wherein said actuation member (8) is a rotary switch with an eccentrically arranged pin (9) in form fitting engagement with said switch accessory (10).

4. A switch assembly, as set forth in claim 2, wherein said switch accessory (10) is an axial pretensioned spring member.

5. A switch assembly, as set forth in claim 1, said switch accessory (10) is axially displaceable between a first end position (I) and a second end position (II) whereby in the first end position (I) only said second switch sleeve (12) of the rotary drive is engaged, in a first axially adjacent intermediate position between said first and second end position thereof said first and second switch sleeves (11, 12) are engaged and in another axially adjacent intermediate position of said switch accessory only said first switch sleeve (11) is engaged and said second switch sleeve (12) is not engaged.

6. A switch assembly, as set forth in claim 5, wherein said second switch sleeve (12) has axially spaced radially extending said coupling members (15', 15") arranged for form fitting engagement with said countershaft (3).

7. A switch assembly, as set forth in claim 6, wherein said coupling member (15") is arranged to interlock a ring (13) in a form fitting and non-rotational manner in said housing (14).

8. A switch assembly, as set forth in claim 5, wherein in said second end position (II) of said switch accessory said countershaft (3) is coupled in a rotation free manner with said housing (14) so that said first switch sleeve (11) of said percussion drive (6) is engaged.

9. A switch assembly, as set forth in claim 1, wherein said coupling member (15) is associated with said first switch sleeve and has a rotation free undercut (19).

10. A switch assembly, as set forth in claim 1, wherein said countershaft (3) extends transversely of said tool spindle (4) and is in meshed engagement therewith via a conical crown gear (3') on said countershaft (3).

* * * * *